US007963751B2

(12) United States Patent
Nakao et al.

(10) Patent No.: US 7,963,751 B2
(45) Date of Patent: Jun. 21, 2011

(54) ELECTROMAGNETIC RECIPROCATING FLUID DEVICE

(75) Inventors: Haruki Nakao, Ohta-ku (JP); Kunihiro Yamamoto, Ohta-ku (JP); Fuminori Hirose, Ohta-ku (JP)

(73) Assignee: Nitto Kohki Co., Ltd., Tokyo (JP)

( * ) Notice: Subject to any disclaimer, the term of this patent is extended or adjusted under 35 U.S.C. 154(b) by 390 days.

(21) Appl. No.: 11/805,663

(22) Filed: May 24, 2007

(65) Prior Publication Data

US 2007/0228312 A1 Oct. 4, 2007

Related U.S. Application Data

(63) Continuation of application No. PCT/JP2005/021052, filed on Nov. 16, 2005.

(30) Foreign Application Priority Data

Nov. 26, 2004 (JP) ..... 2004-342819

(51) Int. Cl.
*F04B 17/00* (2006.01)

(52) U.S. Cl. ..... 417/415

(58) Field of Classification Search ..... 417/415, 417/416, 417, 45; 310/15–24, 36–39; 318/318
See application file for complete search history.

(56) References Cited

U.S. PATENT DOCUMENTS

| | | | | |
|---|---|---|---|---|
| 3,542,495 A | | 11/1970 | Barthalon | |
| 4,135,119 A | * | 1/1979 | Brosens | 318/128 |
| 4,198,743 A | | 4/1980 | Stuber | |
| 4,854,833 A | * | 8/1989 | Kikuchi et al. | 417/417 |
| 5,055,011 A | * | 10/1991 | Mori | 417/417 |
| 5,100,304 A | * | 3/1992 | Osada et al. | 417/417 |
| 5,222,878 A | * | 6/1993 | Osada et al. | 417/417 |
| 5,369,322 A | * | 11/1994 | Maruyama et al. | 310/39 |
| 5,597,294 A | * | 1/1997 | McGrath | 417/417 |
| 5,944,302 A | * | 8/1999 | Loc et al. | 267/180 |
| 6,540,491 B1 | | 4/2003 | Tanabe | |

FOREIGN PATENT DOCUMENTS

| | | |
|---|---|---|
| JP | 1973025563 | 7/1973 |
| JP | 57-30984 B2 | 7/1982 |

* cited by examiner

*Primary Examiner* — Devon C Kramer
*Assistant Examiner* — Amene S Bayou
(74) *Attorney, Agent, or Firm* — Brinks Hofer Gilson & Lione

(57) ABSTRACT

A magnetic armature is attracted and driven by a magnetic force which is intermittently generated between magnetic poles, and a piston reciprocated by being pushed back by a coil spring is not rotated by the coil spring. When the magnetic armature (28) as attracted between the magnetic pole members (10,12) by the magnetic force comes to a predetermined rotational angle position about the axis, the armature receives a rotational torque that is derived from the magnetic force and acts in a direction opposite to that of the rotational torque applied by a coil spring (30), thereby preventing the armature from being rotated in the predetermined direction. More specifically, the armature (28) has a circular cross-section as a whole and has a chamfered part (28') parallel to the axis. When the chamfered part enters between the magnetic pole members, the armature receives a rotational torque that is derived from the magnetic force.

1 Claim, 5 Drawing Sheets

ELECTROMAGNETIC RECIPROCATING FLUID DEVICE

This application is a continuation of PCT/JP2005/021052, filed Nov. 16, 2005, which claims priority to Japanese Application No. JP2004-342819 filed Nov. 26, 2004. The entire contents of these applications are incorporated herein by reference.

BACKGROUND OF THE INVENTION

1. Field of the Invention

The present invention relates to electromagnetic reciprocating fluid devices, e.g. pumps and compressors, including a magnetic circuit having induction coils and a pair of opposed magnetic poles, wherein magnetic force is intermittently generated between the magnetic poles by intermittently exciting the induction coils, and a magnetic armature is attracted and driven by the magnetic force to reciprocate a piston connected to the magnetic armature.

2. Description of the Related Arts

FIGS. 1 and 2 are schematic views of an electromagnetic reciprocating fluid device used as a pump or a compressor.

As illustrated in the figures, the device includes an exciting circuit having induction coils 16 and 18 wound around magnetic pole members 10 and 12, respectively, and a half-wave rectifier 20. The device further includes a piston 24 slidably fitted in a cylinder 22. A magnetic armature 28 is secured to the rod portion of the piston 24. A coil spring 30 urges the piston 24 leftward as viewed in the figures.

When an AC voltage is applied to the exciting circuit, an electric current intermittently flows through the exciting circuit. Thereupon, the induction coils 16 and 18 are intermittently excited, and magnetic force is intermittently generated between the magnetic pole members 10 and 12. When magnetic force is generated, the magnetic armature 28 is magnetically attracted rightward to drive the piston 24 rightward. When the magnetic force disappears, the piston 24 is driven leftward by the coil spring 30. In this way, the piston 24 is driven to reciprocate. The cylinder 22 is provided with a pair of check valves 32 and 34. The reciprocating motion of the piston 24 causes the check valves 32 and 34 to open and close alternately, thereby allowing a fluid to flow in through a fluid inlet 38 formed in a housing 36 and to flow out through a fluid outlet 40 formed in the housing 36.

FIGS. 3 and 4 show an example of a specific arrangement of an electromagnetic reciprocating fluid device.

The device includes magnetic pole members 10 and 12, induction coils 16 and 18, a cylinder 22, a piston 24, a magnetic armature 28, a coil spring 30, check valves 32 and 34, and a housing 36 having a fluid inlet 38 and a fluid outlet 40 in the same way as the device shown in FIGS. 1 and 2. This type of electromagnetic reciprocating fluid device is disclosed, for example, in Patent Document 1 noted below.

FIG. 4 shows the relationship between the magnetic armature 28 and the magnetic pole members 10 and 12. More specifically, the magnetic pole members 10 and 12 are constituted by mutually opposing left and right projecting inner side wall portions of a magnetic circuit member 41 made of a substantially quadrangular magnetic material. The induction coils 16 and 18 are respectively wound around the left and right projecting inner side wall portions constituting the magnetic pole members 10 and 12. Mutually opposing surfaces 10' and 12' of the magnetic pole members 10 and 12 are circular-arc surfaces along a circle with a center axis perpendicularly intersecting the mutual axis of the magnetic pole members 10 and 12 at the center therebetween. The magnetic armature 28 has a circular cross-section with a center axis coincide with the above-mentioned center axis of the circle.

As shown in FIG. 3, the coil spring 30 is set between a piston rod 26 and a support member 36-1 constituting a part of the housing 36. Specifically, the left end of the coil spring 30 is secured by being press-fit into the rear end portion of the piston rod 26. The right end of the coil spring 30 is secured by being press-fit into a spring seat 30-1 rotatably supported on a hemispherical distal end of the support member 36-1.

When the induction coils 16 and 18 are intermittently excited in the device having the above-described structure, the piston 24 is reciprocated right and left as viewed in the figure by magnetic attraction force generated by the induction coils 16 and 18 and the spring force of the coil spring 30, as has been stated above. During the reciprocation of the piston 24, every time the coil spring 30 expands and contracts, it applies rotational torque to the piston 24 in a predetermined direction of rotation about the axis thereof. Accordingly, the piston 24 is rotated little by little every time it reciprocates. For the sake of the following description, let us assume that the piston 24 is rotated clockwise.

PATENT DOCUMENT 1: Japanese Patent Application Publication No. S57-30984

Such a piston displacement causes the following problem. The piston 24 has a strip-shaped liner 44 wound and bonded around the periphery thereof to allow the piston 24 to smoothly slide along the inner peripheral surface of the cylinder 22. The opposite end edges 44-1 and 44-2 of the liner 44 have L-shaped configurations that are complementary to each other as shown in FIG. 3.

When the L-shaped joint between the end edges 44-1 and 44-2 of the liner 44 comes to the position in the cylinder 22 where the check valve 32 is provided as a result of the piston 24 being intermittently rotated as it reciprocates, as stated above, a fluid leakage occurs through the joint, which causes generation of large noise.

An object of the present invention is to hold the piston, and hence the armature, in a predetermined angular position so that it will not rotate as in the above-described conventional device, thereby preventing the generation of noise.

The present invention provides an electromagnetic reciprocating fluid device including a piston having a piston rod and a magnetic armature secured to the piston rod. The piston is reciprocatable along the longitudinal axis of the piston rod. The device further includes a magnetic circuit having a pair of magnetic pole members spaced from each other in a direction perpendicularly intersecting the axis. The magnetic circuit is intermittently excited to generate magnetic force between the magnetic pole members, thereby magnetically attracting the armature to drive the piston in the direction of the axis. Further, the device includes a coil spring that urges the piston in a direction opposite to the direction in which the piston is magnetically attracted and driven by the magnetic circuit. Every time the piston is reciprocated in the direction of the axis by the magnetic force of the magnetic circuit and the urging force of the coil spring, the piston is driven to rotate in a predetermined direction by rotational torque applied thereto by the coil spring. The electromagnetic reciprocating fluid device is characterized in that the magnetic armature has magnetic properties with which the armature receives a rotational torque that is derived from the magnetic force and acts in a direction opposite to that of the rotational torque applied by the coil spring when the armature as attracted between the magnetic pole members by the magnetic force comes to a predetermined rotational angle position about the axis, thereby preventing the armature from being rotated in the predetermined direction. Specifically, the armature receives rotational torque in a direction opposite to that of the rotational torque applied by the coil spring that is generated by the magnetic force in accordance with the rate of change of permeance between the magnetic pole members caused by the rotation of the armature.

The armature has a first angle range portion defining a predetermined angle range about the axis and a second angle range portion defining an angle range that is different from that of the first angle range portion. The armature has magnetic properties with which the armature is driven to rotate in the predetermined direction by the rotational torque applied to the piston by the coil spring when the first angle range portion is present in the magnetic circuit between the magnetic pole members, but when the second angle range portion enters between the magnetic pole members, the magnetic force between the magnetic pole members generates a rotational torque that drives the piston to rotate in a direction opposite to the predetermined direction against the rotational torque applied thereto by the coil spring.

More specifically, the arrangement may be as follows. The armature has a circular cross-section as a whole and has a chamfered part parallel to the axis. The chamfered part constitutes the second angle range portion, and the portion of the armature other than the chamfered part constitutes the first angle range portion.

In another specific example, the arrangement may be as follows. The armature has a circular cross-section as a whole and has a through-hole extending therethrough at a predetermined angle position about the axis. An angle portion of the armature including the through-hole constitutes the second angle range portion, and the portion of the armature other than the angle portion constitutes the first angle range portion.

DESCRIPTION OF THE PREFERRED EMBODIMENTS

Embodiments of the electromagnetic reciprocating fluid device according to the present invention will be described below with reference to FIGS. 5 and 8.

Figure 1:
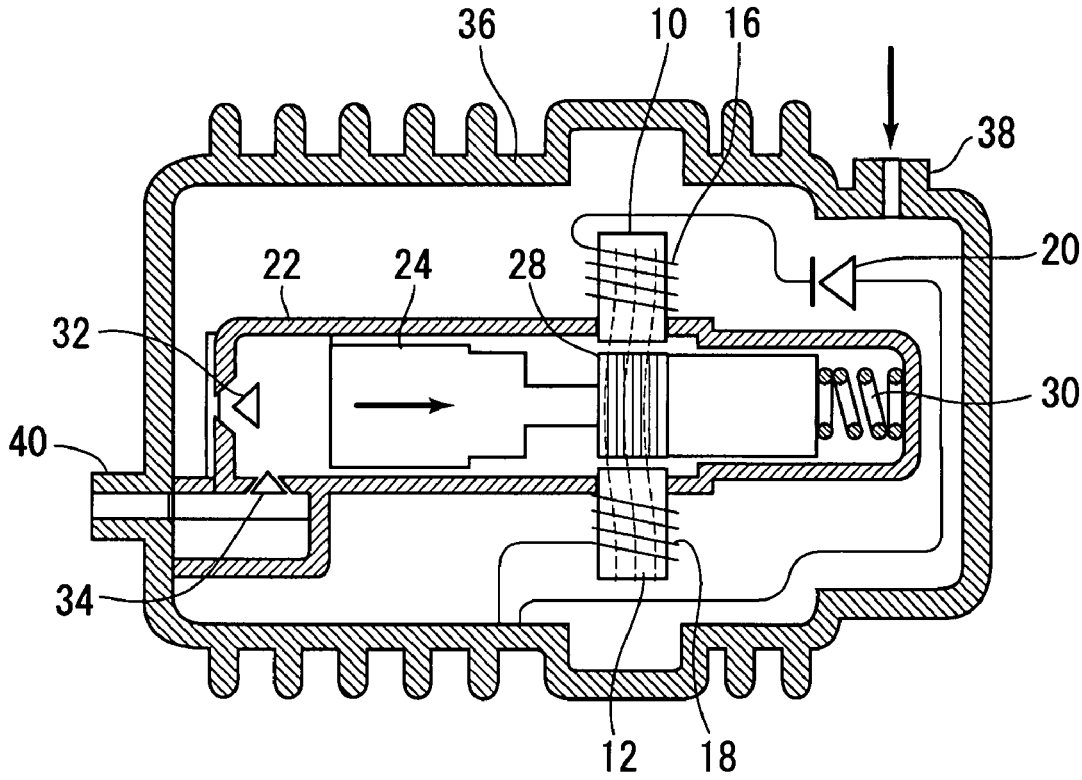
FIG. 1 is a schematic view of an electromagnetic reciprocating fluid device, showing the way in which a fluid is sucked to flow into the device.
Figure 2:
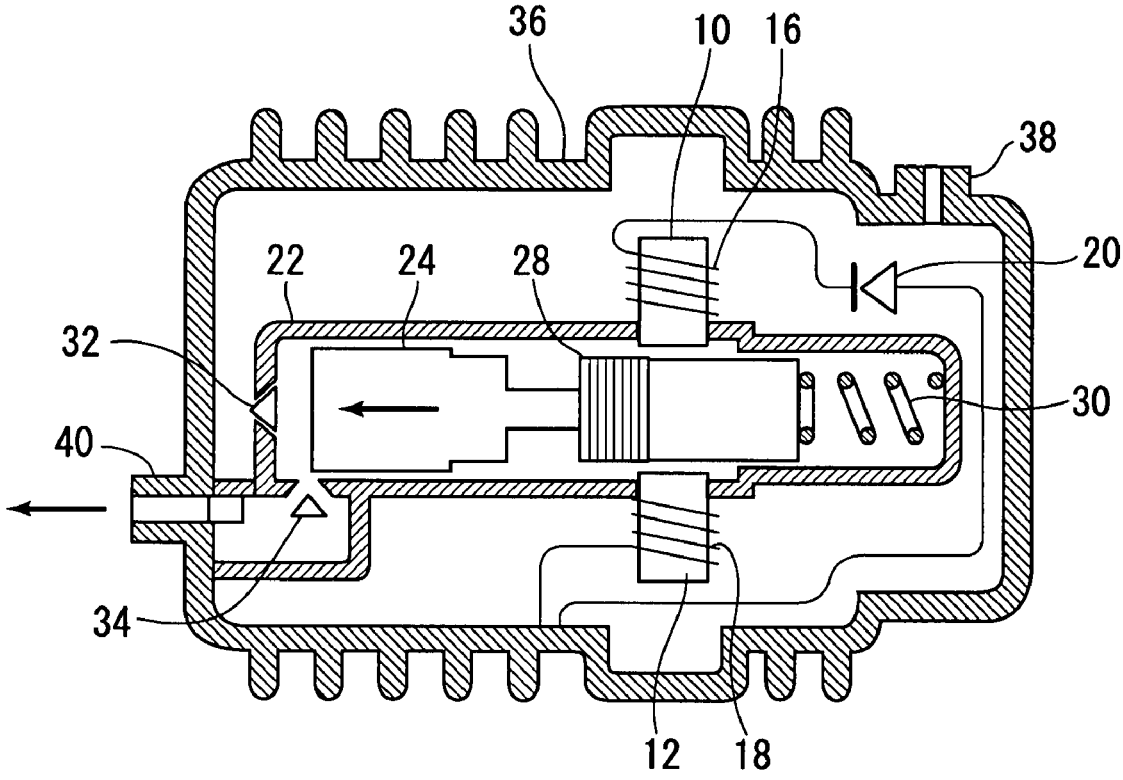
FIG. 2 is a schematic view of the electromagnetic reciprocating fluid device, showing the way in which the fluid is discharged from the device.
Figure 3:
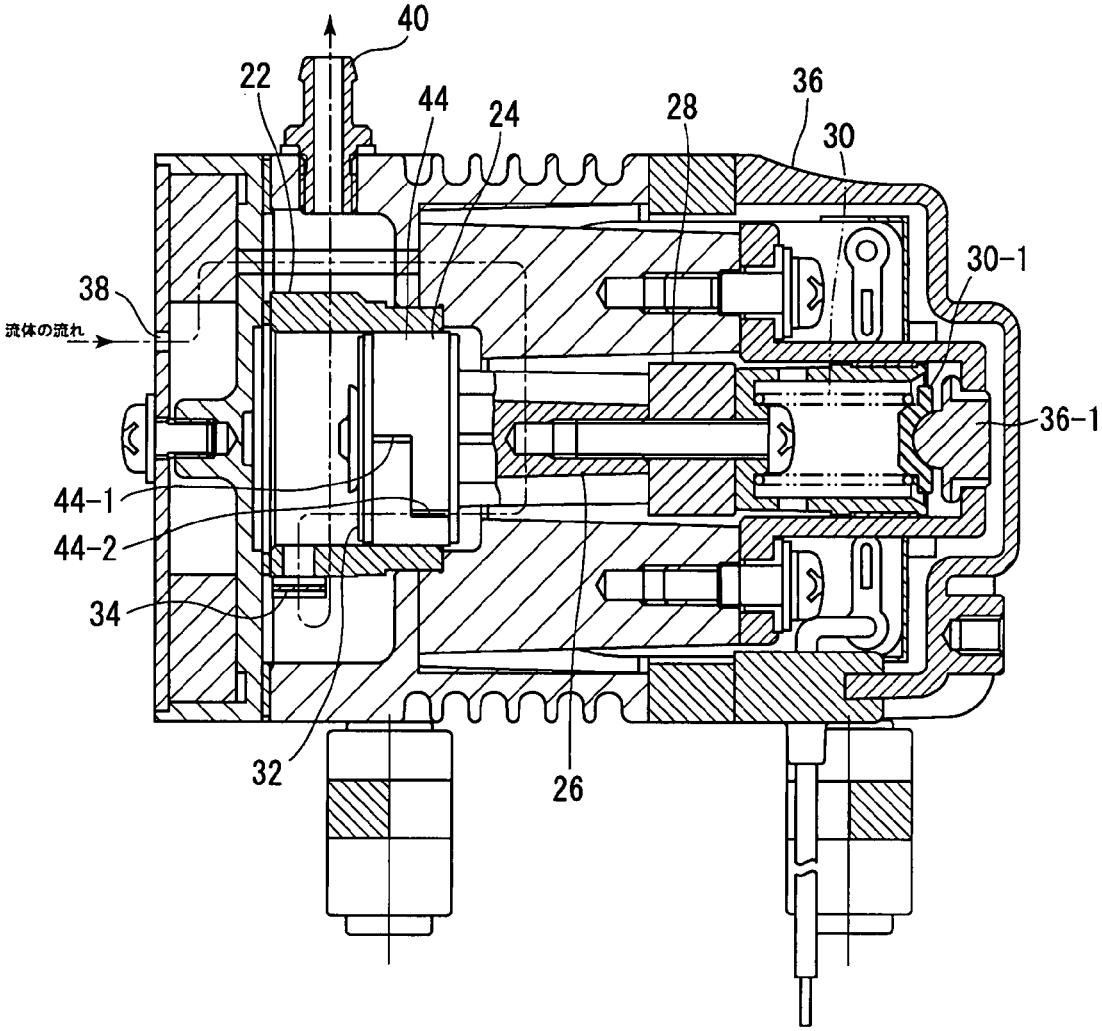
FIG. 3 is a longitudinal sectional side view of a conventional electromagnetic reciprocating fluid device.

The general structure of the electromagnetic reciprocating fluid device according to the present invention is substantially the same as that shown in FIG. 3. It should be noted, however, that the magnetic armature 28 of the device according to the present invention has a cross-section that is not completely round, unlike that of the above-described conventional device.

Figure 5:
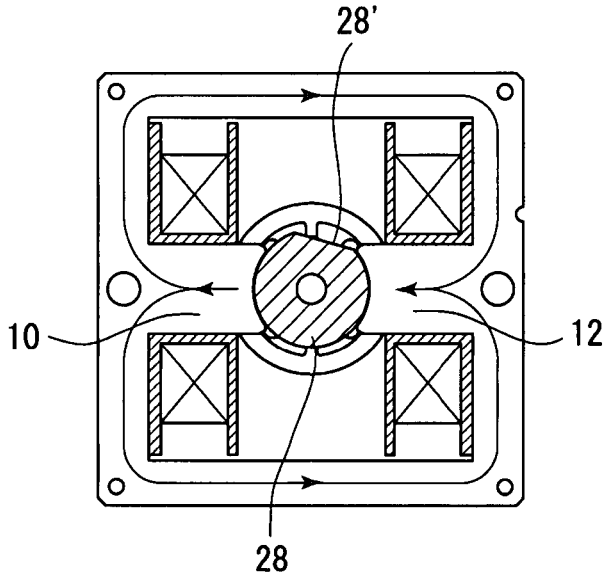
FIG. 5 is a sectional view similar to FIG. 4, showing an electromagnetic reciprocating fluid device according to the present invention.

FIG. 5 shows a first embodiment of the electromagnetic reciprocating fluid device according to the present invention. In this embodiment, the armature 28 is provided with a chamfered part 28' extending along the direction of the axis thereof.

It has been confirmed that the armature 28 formed with a cross-sectional configuration as shown in the figure can be held substantially in the illustrated position in the rotational direction even when the piston is reciprocated. The reason for this may be explained as follows.

A. The relationship between rotational torque T and electromagnetic energy W:

Letting dW represent a change in electromagnetic energy W caused by the rotation of the armature 28, force F is expressed by:

$$F=dW/rd\theta \quad \text{(A-1)}$$

where:

r is the distance from the point of application of force F to the center about which torque is applied; and dθ is the angle of displacement.

Rotational torque T is, as is commonly known, given by:

$$T=Fr \quad \text{(A-2)}$$

From Equations (A-1) and (A-2), rotational torque T is expressed by:

$$T=dW/d\theta \quad \text{(A-3)}$$

B. Electromagnetic energy W in a magnetic circuit:

In a circuit including a coil, electromagnetic energy W stored in the coil is, as is commonly known, given by:

$$W=1/2LI^2 \quad \text{(B-1)}$$

where:

L is the self-inductance of the coil; and

I is the electric current passed through the circuit.

As is generally known, the self-inductance L of an annular coil is given by:

$$L=PN^2 \quad \text{(B-2)}$$

where P is permeance.

From Equations (B-1) and (B-2), electromagnetic energy W stored in the magnetic circuit is expressed by:

$$W=1/2(NI)^2P \quad \text{(B-3)}$$

From Equations (A-3) and (B-3), rotational torque T is expressed by:

$$T=1/2(NI)^2dP/d\theta \quad \text{(AB-1)}$$

C. The armature 28 shown in FIG. 5 is formed with the chamfered part 28'. Accordingly, when the armature 28 rotates about its center axis, the air gap between the magnetic pole members 10 and 12 changes. Hence, the permeance P of the air gap also changes.

Figure 6A:
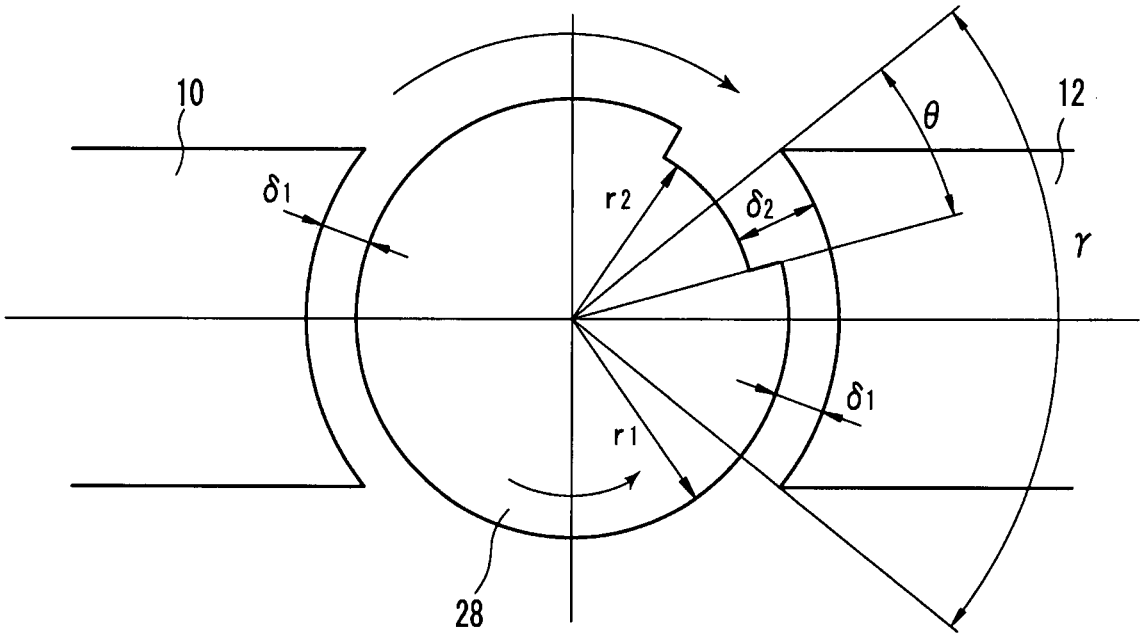
FIG. 6*a* is a diagram showing the relationship between an armature and magnetic pole members to explain the electromagnetic reciprocating fluid device according to the present invention.
Figure 6B:
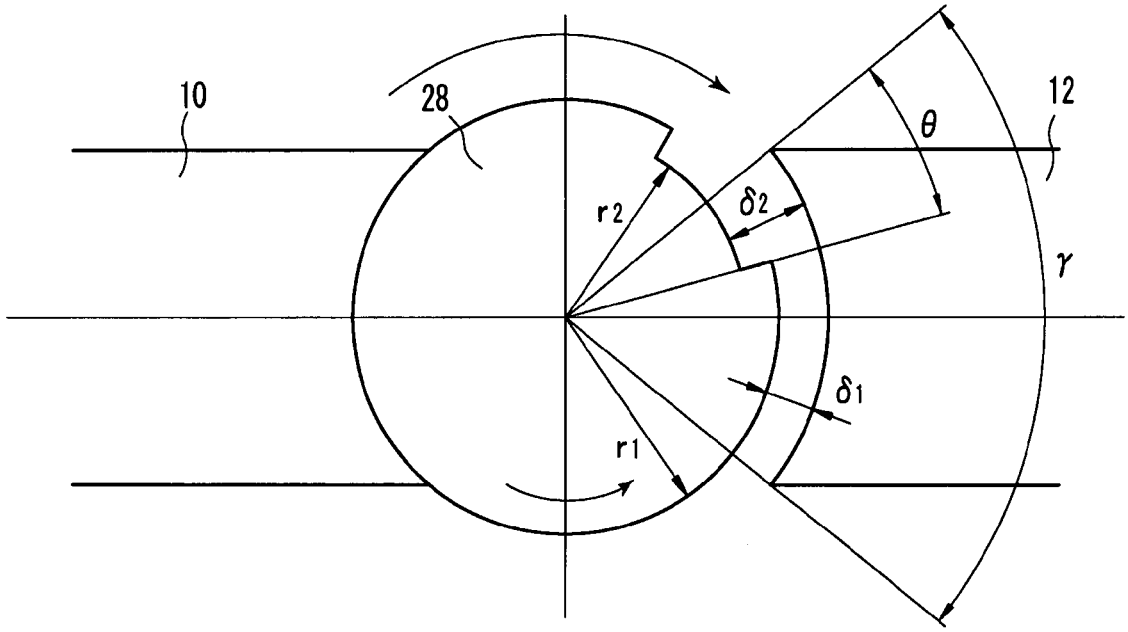
FIG. 6*b* is a diagram schematically illustrating the relationship between the armature and the magnetic pole members in FIG. 6*a*.

To clarify the relationship between the change of the air gap and the change of the permeance, let us consider a modeled relationship between the magnetic pole members 10 and 12 and the armature 28 as shown in FIG. 6*a*. Let us assume that the armature 28 has a portion with a radius $r_1$ and a recessed portion with a radius $r_2$. To simplify the mathematical expression, it is assumed that when the portion of radius $r_1$ is in sliding contact with the magnetic pole member 10, as shown in FIG. 6*b*, air gaps $\delta_1$ and $\delta_2$ are formed between the magnetic pole member 12 and the portion of radius $r_1$ and the portion of radius $r_2$, respectively, and an angle $\gamma$ is formed between imaginary lines connecting the center axis of the armature 28 and the upper and lower end edges, respectively, of the magnetic pole member 12 (as viewed in FIGS. 6*a* and 6*b*). In this model, let us assume that the armature 28 rotates clockwise so that the recessed portion thereof enters the magnetic circuit between the magnetic pole members 10 and 12 from one end thereof, and the angle made between the one end of the recessed portion of the armature 28 and the upper end edge of the magnetic pole member 12 (as viewed in FIGS. 6*a* and 6*b*) is represented by $\theta$. The permeance P of the air gap between the magnetic pole members 10 and 12 at this time is expressed by the following equation on the condition that $\delta_1$ and $\delta_2 \ll r_1$ and $r_1 \approx r_2 \approx r$:

$$P=\mu r(\gamma-\theta)t/\delta_1+\mu r\theta t/\delta_2 \quad \text{(C-1)}$$

where:

$\mu$ is the permeability in a vacuum; and t is the thickness of the armature and the magnetic pole members.

The amount of change in P with the change of $\theta$ is given by:

$$dP/d\theta = -\mu rt/\delta_1 + \mu rt/\delta_2 \quad \text{(C-2)}$$
$$= \mu rt(\delta_1 - \delta_2)/\delta_1\delta_2$$

From Equations (AB-1) and (C-2), torque T acting on the armature is given by:

$$T = 1/2\cdot(NI)^2 dP/d\theta \quad \text{(C-3)}$$
$$= 1/2\cdot(NI)^2\cdot\mu rt(\delta_1 - \delta_2)/\delta_1\delta_2$$

In Equation (C-3), N, $\mu$, r, t, $\delta_1$ and $\delta_2$ are all constants, and $I=I_{max}\sin\omega t=I_{rms}$. Under certain conditions, I is constant, and hence torque T is constant.

When the recessed portion of the armature 28 is not present between the magnetic pole members 10 and 12, the permeance P of the air gap between the magnetic pole members 10 and 12 is given by:

$$P=\mu r\gamma t/\delta_1$$

P, in this case, is constant independently of the displacement angle of the armature 28 and not a function of $\theta$.

Accordingly, torque, which is expressed by $T=1/2\cdot(NI)^2 dP/d\theta$, is:

$$T=0$$

Figure 7:
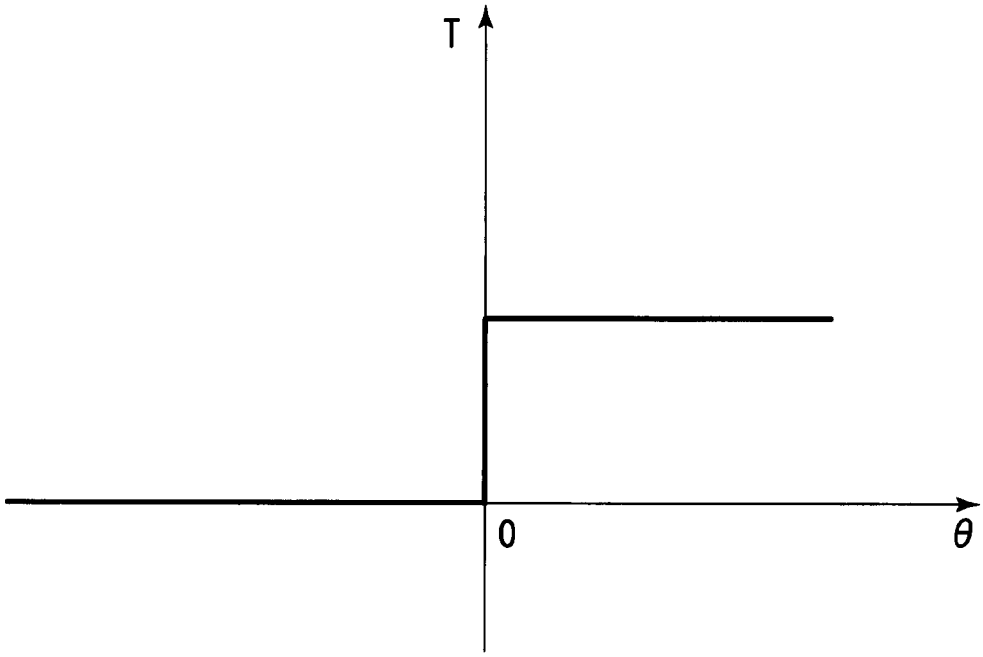
FIG. 7 is a chart showing the change of rotational torque generated by magnetic force that acts on the armature in the electromagnetic reciprocating fluid device according to the present invention.

Accordingly, torque T before and after the angle $\theta$ becomes zero ($\theta=0$) is as shown in FIG. 7.

Figure 4:
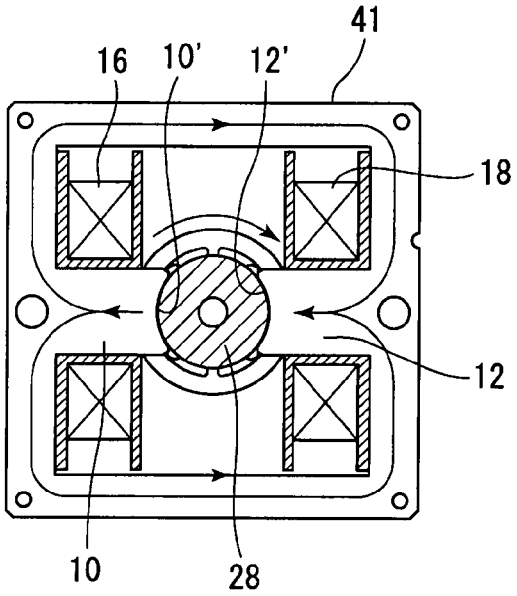
FIG. 4 is a sectional view taken along the line IV-IV in FIG. 3.

It will be understood from the above that even if the portion of the armature that is involved in the magnetic circuit is displaced around the axis of the armature, no torque is applied from the magnetic circuit to the armature when there is no change in permeance P between the magnetic pole members 10 and 12 (i.e. when the permeance P is not a function of the rotational angle of the armature). Accordingly, in this case, the armature is rotated according to the rotational torque applied thereto by the coil spring. It may be considered that the rotation of the armature in the conventional device in FIG. 4 is caused as stated above.

In contrast, if the portion of the armature that is involved in the magnetic circuit causes a change in permeance of the magnetic circuit as the armature is angularly displaced around the axis thereof (i.e. if the permeance is a function of the rotational angle of the armature), rotational torque is applied to the armature. The rotational torque in this case acts on the armature in either a clockwise or counterclockwise direction depending on the term $(\delta_1-\delta_2)$ in the above-described Equation of $T=1/2\cdot(NI)^2\cdot\mu rt(\delta_1-\delta_2)/\delta_1\delta_2$. A detailed description of this action is omitted, but specifically, the rotational torque acts in a direction in which the permeance between the magnetic pole members increases with the rotational displacement of the armature. In the example shown in FIG. 5, when the armature 28 is rotationarily moved clockwise and the chamfered part 28' enters between the magnetic pole members 10 and 12, the permeance decreases. Accordingly, the rotational torque generated by magnetic force acts in a direction counter to the rotational motion of the armature 28. Therefore, if the rotational torque generated by magnetic force is designed to be larger than the rotational torque applied to the armature 28 by the coil spring 30, the armature 28 is pushed back when the chamfered part 28' enters between the magnetic pole members 10 and 12. When the chamfered part 28' has come out from between the magnetic pole members 10 and 12, the rotational torque generated by magnetic force becomes zero, so that the armature 28 is rotationarily moved clockwise again. The reason why the chamfered part 28' is held at the illustrated position in the example shown in FIG. 5 is due to equilibrium brought about by the rotational torque from the coil spring 30 and the rotational torque from the magnetic force between the magnetic pole members 10 and 12.

Figure 8:
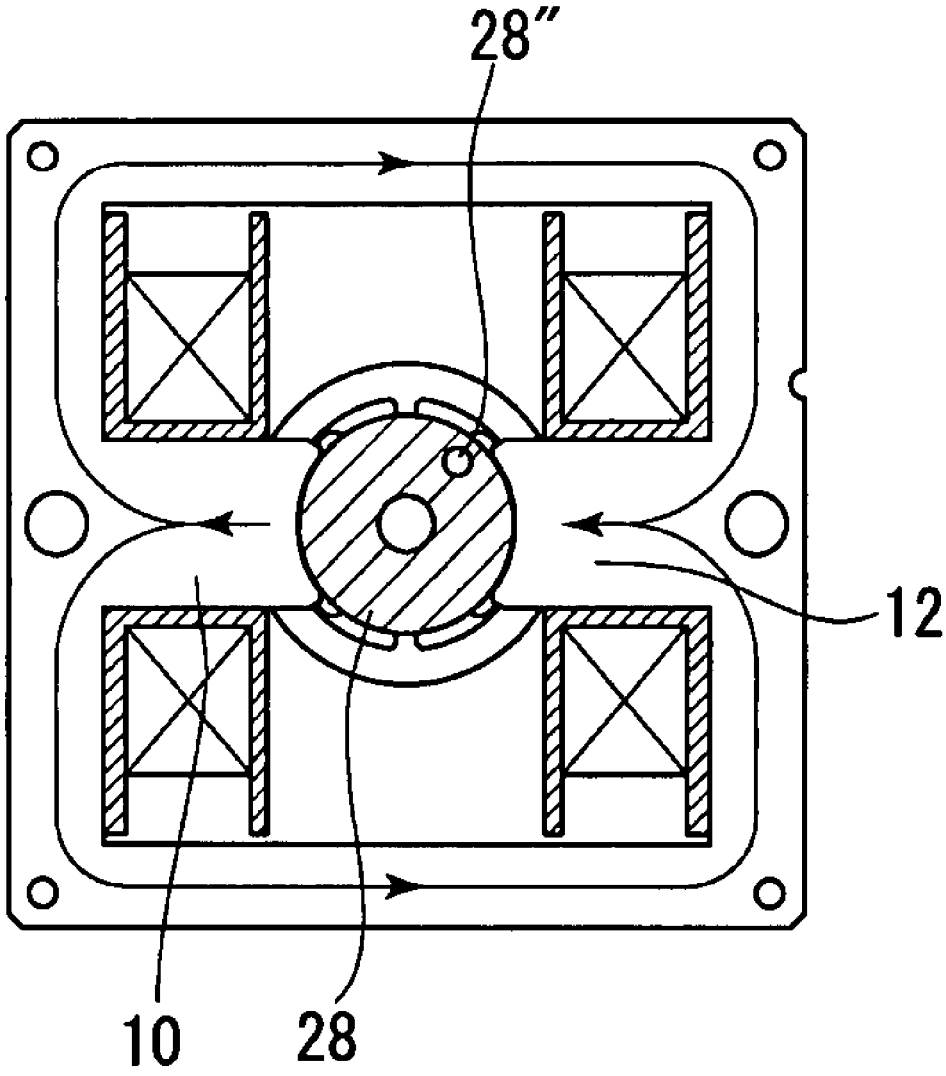
FIG. 8 is a sectional view similar to FIG. 5, showing a second embodiment of the electromagnetic reciprocating fluid device according to the present invention.

FIG. 8 shows another embodiment of the magnetic armature 28 in the device according to the present invention. The armature 28 in this embodiment is provided with a through-hole 28" extending in the direction of the axis thereof in place of the above-described chamfered part. In this case also, when the through-hole 28" enters between the magnetic pole members 10 and 12 as the armature 28 is rotationarily moved clockwise by the action of the coil spring 30, the permeance P changes with the angular position of the through-hole 28". Consequently, the armature 28 receives rotational torque generated by magnetic force. Specifically, when the through-hole 28" enters between the magnetic pole members 10 and 12, the permeance becomes lower than before. Therefore, the rotational torque generated by magnetic force acts in a direction in which the permeance increases, i.e. in a direction in which the armature 28 is urged to rotate counterclockwise. Accordingly, the magnetic armature 28 is held substantially in the angle position illustrated in the figure.

Although the embodiments of the electromagnetic reciprocating fluid device according to the present invention have been shown above, the armature is not necessarily limited to those in these embodiments. The above-described chamfer or through-hole 28' is not necessarily limited to the illustrated configuration but may have any configuration that is not symmetric in terms of magnetic reluctance with respect to the axis of the magnetic armature 28. The armature in each of the foregoing embodiments has a completely round cross-section as a whole and is arranged such that when the portion thereof that is not provided with either a chamfer or through-hole 28' is present between the magnetic pole members, no rotational driving force is generated by magnetic force, thus allowing the armature and the piston to be rotationarily moved in a predetermined direction by rotational driving force from the coil spring. The portion that is not provided with either a chamfer or through-hole 28', however, need not necessarily be completely round. Even if this portion of the armature is configured so that the magnetic force generates a rotational torque when it is present between the magnetic pole members, the coil spring occurs will rotationarily move the armature, provided that the rotational torque generated by magnetic force is smaller than the rotational torque applied by the coil spring. It is essential only that a rotational torque that is larger than and counter to the rotational torque applied by the coil spring be generated by magnetic force when the armature comes to a predetermined angular position so that a portion thereof that is appropriately configured, such as being provided with the above-described chamfer or through-hole 28', enters between the magnetic pole members.

The invention claimed is:

1. An electromagnetic reciprocating fluid device comprising:

a piston having a piston rod and a magnetic armature secured to the piston rod, the piston reciprocating along a longitudinal axis of the piston rod;

a single magnetic circuit having a pair of magnetic pole members spaced from each other in a direction perpendicularly intersecting the axis, the single magnetic circuit being intermittently excited to generate magnetic force between the magnetic pole members, thereby intermittently magnetically attracting the armature to drive the piston a predetermined direction along the axis; and a coil spring that urges the piston in a direction opposite to the direction in which the piston is magnetically attracted and driven by the single magnetic circuit;

wherein the armature has a circular arc surface part centered around and extending in parallel with the axis and having opposite edges in parallel with the axis and a flat surface part extending between the opposite edges of the circular arc surface part and in parallel with the axis;

wherein the pair of magnetic pole members have circular arc surfaces that are centered around and extend in parallel with the axis and are opposite to each other;

further wherein the armature is arranged such that the flat surface part is positioned outside a space between the opposing circular arc surfaces of the pair of the magnetic pole members and, as the flat surface part enters the space due a rotational movement of the armature in response to the reciprocation of the piston in the predetermined direction, permeance between the magnetic pole members decreases and the magnetic force generates a torque that drives the armature in a direction opposite to the rotational movement of the armature to prevent the armature from being further rotated in the predetermined direction.

* * * * *